US005685391A

United States Patent [19]

Gundlach

[11] Patent Number: 5,685,391

[45] Date of Patent: Nov. 11, 1997

[54] TRILADDER

[76] Inventor: James Gundlach, 5 S. 323 Beau Bien Blvd., Naperville, Ill. 60563

[21] Appl. No.: 655,559

[22] Filed: May 30, 1996

Related U.S. Application Data

[63] Continuation-in-part of Ser. No. 282,933, Jul. 29, 1994, abandoned.

[51] Int. Cl.[6] ..... E06C 7/00

[52] U.S. Cl. ..... 182/104; 182/119

[58] Field of Search ..... 182/104, 180, 182/228, 115, 116, 117, 119, 105, 152; 218/165, 168, 169

[56] References Cited

U.S. PATENT DOCUMENTS

| | | | |
|---|---|---|---|
| 160,081 | 2/1875 | Carnes . | |
| 355,574 | 1/1887 | Tilley | 182/228 X |
| 461,366 | 10/1891 | ODom | 182/104 |
| 1,258,048 | 3/1978 | Ryder . | |
| 1,529,898 | 3/1925 | Lucke . | |
| 1,548,410 | 8/1925 | Derbyshire | 248/165 X |
| 1,718,885 | 6/1929 | William | 182/152 |
| 2,661,082 | 4/1953 | Ziegle | 189/14 |
| 4,796,843 | 1/1989 | O'Connor | 248/168 |

FOREIGN PATENT DOCUMENTS

| | | | |
|---|---|---|---|
| 344595 | 11/1904 | France | 182/104 |
| 881547 | 4/1943 | France | 182/104 |
| 093716 | 4/1994 | Japan | 182/222 |

*Primary Examiner*—Alvin C. Chin-Shue
*Attorney, Agent, or Firm*—Jefferson Perkins

[57] ABSTRACT

A connecting device (10) is adaptable to assemble one, two or three ladders (72, 74, 76) into a tripod structure. A body (12) of the connecting device has six rung receivers (28) affixed thereto and outwardly projecting therefrom in pairs, with each pair of receivers projecting at an angle to the other pairs and at an angle to the vertical. Where three ladders are not available, support members (140, 160) may be employed to form one or two of the tripod legs.

1 Claim, 8 Drawing Sheets

FIG. 1
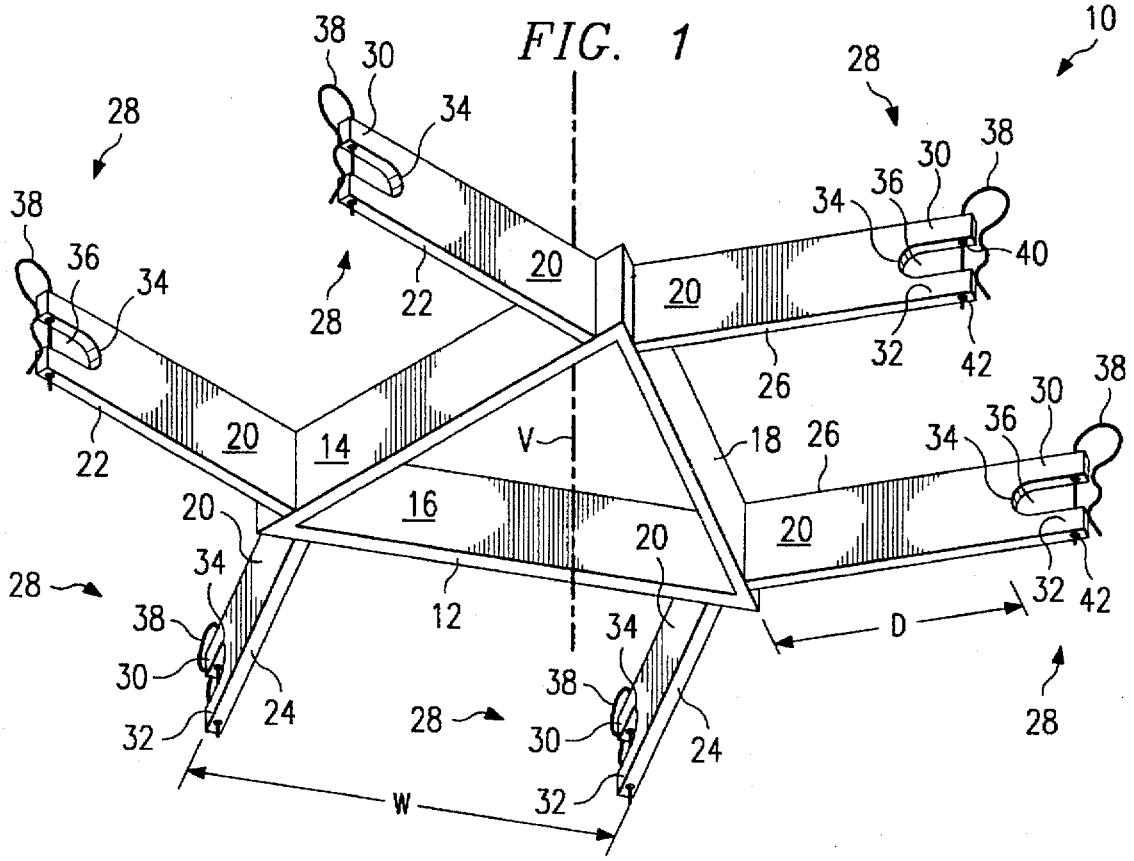
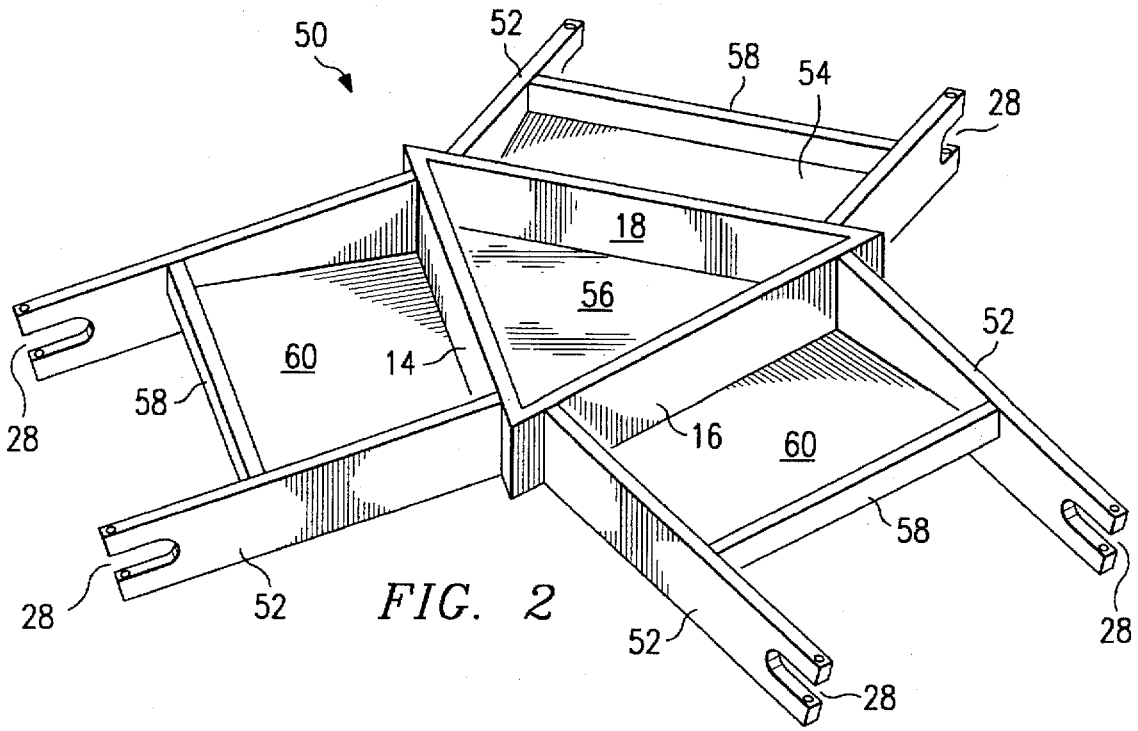
FIG. 2

TRILADDER

RELATED APPLICATION

This application is a continuation-in-part of application Ser. No. 08/282,933, filed Jul. 29, 1994, abandoned.

TECHNICAL FIELD OF THE INVENTION

The present invention relates in general to ladders, and more particularly to an accessory for use with ladders to create a tripod therefrom.

BACKGROUND OF THE INVENTION

Traditional ladders and extension ladders have the characteristic of having to be leaned against something to enable a person to climb and stand in a raised position. A prior art solution to this limitation is the step-ladder, which provides an outwardly extensible leg element that is pivotally connected to the top of the ladder element. When the ladder is pulled apart at the bottom, a self-standing device is created on which a person can stand and do work above his normal reach. Step-ladders are unstable unless they are on a fairly level surface, and users are warned of stability problems if they stand on the top or on the uppermost rung.

Another way to create a raised work surface is through the use of scaffolding, which is cumbersome, has to be built or rolled into place, and generally cannot be arranged to perform work over something which would be under the central portion of the scaffolding. For example, in a room containing mounted or unmounted benches, tables or the like, the benches or tables would usually have to be removed from the area where the scaffolding would be moved to and operated.

Three-sided ladders are known in the art, as illustrated by Odom, U.S. Pat. No. 461,366. The Odom structure is, in essence, a custom-built three-sided step-ladder which cannot be conveniently stored; its ladder elements are permanently hinged to its top and cannot be conveniently used by themselves. Odom hinges the custom ladder element together using a platform at the top that, as with the top step of a step-ladder, would not be practical for use because of standard practices of warning against standing on the top of the step-ladders. A need therefore persists for ladder apparatus which will provide a stable structure on unlevel ground, which will be self-supporting and which may be assembled using common ladders or extension ladders.

SUMMARY OF THE INVENTION

According to one aspect of the invention, a device is provided for assembling three ladders into a tripod. The device includes a rigid body and first, second and third pairs of rung receivers which are affixed to the body. Each pair of the rung receivers extends outwardly from the body in a direction at an angle to the other pairs of the rung receivers and at an angle with respect to the vertical. Each rung receiver in a pair is spaced from the other rung receiver in that pair by a width predetermined to be less than the width of a ladder rung to be received by that rung receiver pair. Preferably, each rung receiver has an upper tine and a lower tine which extend in parallel to each other and outwardly from the body. The rung receiver defines a space which is adaptable to receive a rung of a ladder, such that when selected rungs of the three ladders are inserted into respective rung receiver pairs, a tripod may be erected in which each ladder serves as a leg of the tripod. It is preferred that a pin, clip or other retainer be used to retain each ladder rung inside a pair of rung receivers after that rung has been inserted.

In one embodiment of the invention, the rung receivers are horizontally displaced outwardly from the body by respective arms or body extensions which have a width which is preselected to be smaller than the interior distance between the side rails of the top of the ladder to which the rung receivers are adapted to be attached. In this way, three ladders may be assembled to the device on the ground in a flat condition, and the entire apparatus raised vertically after assembly without interference from the tops of the ladders. This horizontal offset from the center of the body may be implemented by, for example, separate arms, free ends of which have formed thereon the rung receivers.

In another embodiment, the body is formed with six angle irons arranged in three pairs of two and each having separate branches which are joined at an angle to each other. The upper and lower tines of the rung receivers are formed by the ends of the angle iron branches; the branches horizontally offset the rung receivers from the center of the construction by a distance sufficient to prevent fouling of the ladder tops when assembling the triladder. Suitable vertical and horizontal tie members connect the angle irons together to form a rigid structure. The horizontal offset provided by the arms or body extensions is also useful when joining the ladders at points substantially removed from the top thereof.

The arms or outward body extensions may be formed to extend outwardly from the body at an angle of 90° from the vertical, or alternatively may extend outwardly and downwardly at a more acute angle to the vertical, such as 60° or 75°.

According to a further embodiment of the invention, an apparatus for assembling at least three ladders into a multi-legged platform has a rigid body, and first, second and third extensions of the body extending away from the axis in first, second and third directions that are angularly spaced from each other. Each of the extensions has a rung receiver formed on an end thereof remote from the axis. Each of the rung receivers is adaptable to receive a rung of a respective ladder at at least two spaced-apart points thereof. The rungs are received by the rung receivers in a direction that forms an angle to the axis, and preferably the rungs are received in a direction which is orthogonal to the axis. This last embodiment of the invention may be formed by a top and a bottom plate made out of a metal such as galvanized or stainless steel or aluminum. End flanges of each of the extensions of the top and bottom plates form tines or flange pairs of the rung receivers. Each of the extensions of the top and bottom plates has sidewalls which are formed at an angle to the top and bottom surfaces of the plates. The bottom margins of the sidewalls of the top plate are joined to top margins of the sidewalls of the bottom plate. Outward margins of these sidewalls form stops against which each of the received rungs abut, and the end flanges of the plate extensions extend beyond these outward margins of the sidewalls so as to form a rung receiver that bounds the received rung on three sides.

According to another aspect of the invention, the central connecting device may be used with only one or two ladders, with one or more elongated support members being provided as a substitute or substitutes for one or two of the other ladders used to form legs of the tripod. Each support member has a pole with a lower end and an upper end to which is affixed a crosspiece. The length and diameter of the crosspiece are selected such that it may be conveniently received by a pair of rung receivers in substitution for a rung of a ladder. The crosspiece ends have attached thereto appropriate stop members which are sufficiently large to prevent disengagement by horizontal displacement of the rung receiver pair in question with respect to the crosspiece.

The present invention provides for an assembly of three ladders arranged in a tripod shape, which is stable and very versatile in its application and which can be used in conjunction with just about any conventional ladder, extension or otherwise.

Applicant's invention can be used to avoid problems relating to standing on a top platform because there is no necessity for the Applicant's connecting unit, which could have a platform-like element in the center, to be mounted on the very top rung of the three component ladder elements. If, for example, one or more of the ladders would be affixed to the rung below the top one, there would be at least one upwardly extending segment for providing potential support for someone who is standing on the platform portion itself. The present invention has further technical advantages in that it may be assembled on an uneven surface with ladders that are, or are made to be, of unequal length. Further, because it avoids the use of custom ladder elements, the ladder elements used with the invention can be employed in a more traditional manner, and the connecting device of the invention and support members can be conveniently stored in a flat condition.

BRIEF DESCRIPTION OF THE DRAWINGS

Further aspects of the invention and their advantages may be discerned with reference to the following drawings, in which like numbers denote like parts and in which:

FIG. 1 is an isometric view of a ladder connecting device according to a first embodiment of the invention;

FIG. 2 is an isometric view of a modification of the embodiment shown in FIG. 1;

DETAILED DESCRIPTION OF THE INVENTION

Figure 3:
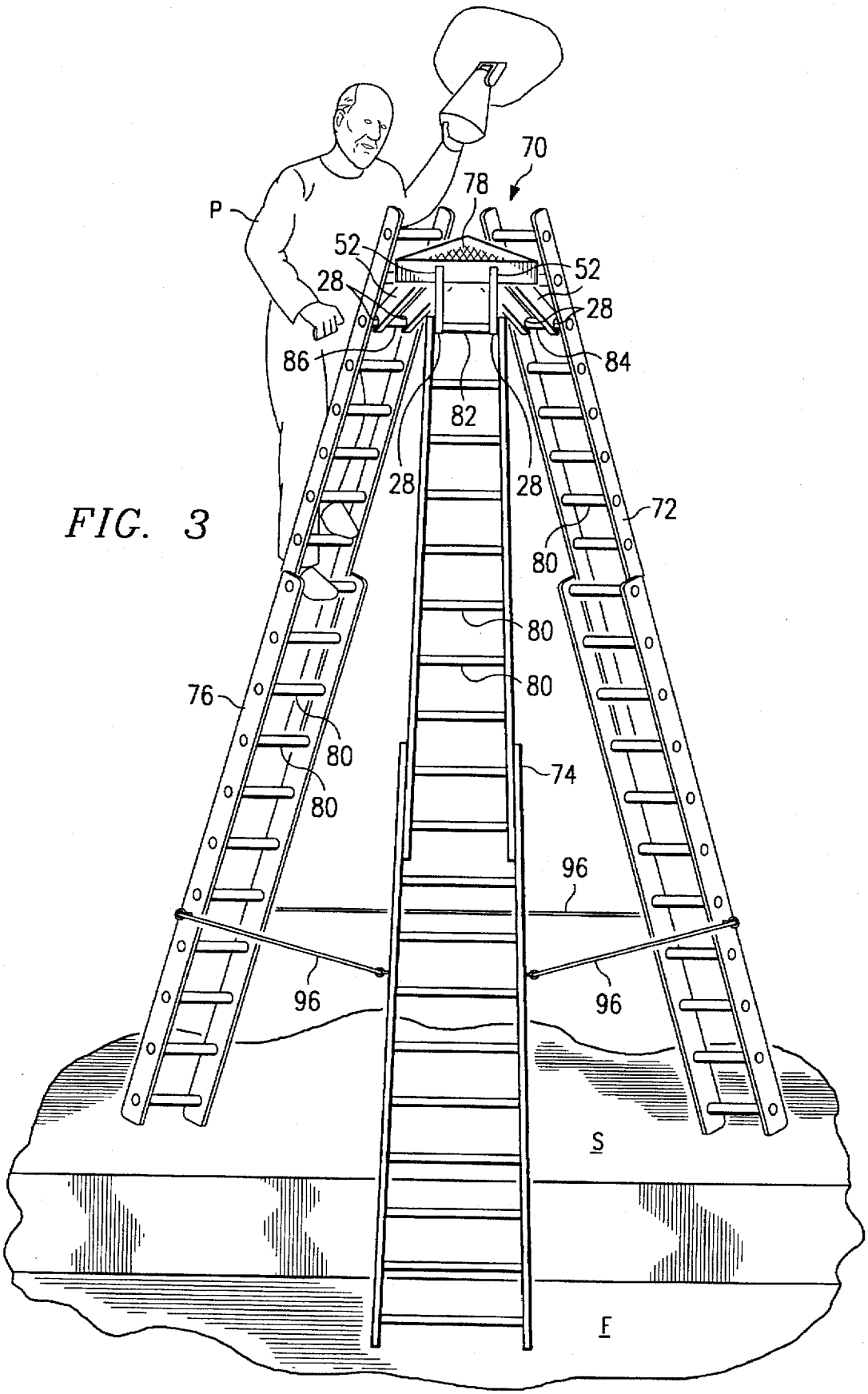
FIG. 3 an isometric view of the connecting device of the invention in operation to create a triladder on an uneven surface.

FIG. 1 illustrates a first embodiment of a connecting device according to the invention and indicated generally at 10. The device 10 includes a body 12 which is formed of three elongated rectangular panels 14, 16 and 18, which are assembled end-to-end to form a triangle. In the illustrated embodiment, the triangle is equilateral, although other triangular shapes could be used if other than an equilateral tripod is desired.

Each panel 14, 16 and 18 has affixed thereto a pair of arms 20. Each arm 20 of a first pair of arms 22 has an end thereof affixed to the body panel 14. Arms 20 of the pair 22 project outwardly from the body panel 14 in parallel to each other. In like fashion, each arm 20 in a pair of arms 24 projects outwardly from the exterior face of body panel 16, and each arm 20 in a pair of arms 26 projects outwardly from the exterior face of body panel 18.

Each of the arms 20 in a particular pair is separated from the other arm in the pair by a predetermined width w. The width w is selected to be less than that of a rung of a ladder to be received that pair of the arms 20, as will be shown in more detail in conjunction with FIGS. 3 and 4.

Each arm 20 has formed on its free end a rung receiver indicated generally at 28. In the illustrated embodiment, each rung receiver 28 includes an upper tine 30 which extends outwardly from the body of arm 20, a lower tine 32 which extends outwardly in parallel to upper tine 30 and a base or seat 34. Tines 30 and 32 are adapted to pass over and under a rung of a ladder and define a space 36 for the receipt of a ladder rung therebetween.

A retainer or closure is also provided to secure the ladder rung into the space 36 after insertion. In the embodiment illustrated in FIG. 1, this device is a "hair clip" 38 which is inserted through a bore 40 in the upper tine 30 and through an aligned bore 42 in the lower tine 32. Although not shown, like "hair clips" 38 are provided for the remaining rung receivers 28. In alternative embodiments, other means to secure to the rung inside the rung receiver spaces 36 can be used, such as pins, latches, gates, bolts, or bars or other closures known in the art.

In one embodiment, the distance d between the base or seat 34 and the exterior surface of the panel to which the arm 20 is attached, such as panel 18, is preselected to be greater than the distance from the top rung of a ladder to the top of the side rail of that. This allows the assembly of three such ladders in a flat condition on the ground with the subsequent raising of the device 10 and the three attached ladders to a tripod condition without physical interference from the body 12. In other embodiments in which the connecting device 10 is used for taller ladders, the standoff provided by distance d, while not allowing assembly of ladders in a flat condition, nonetheless makes assembly easier and permits the assembly of the ladders at points substantially below their top ends. The device 10 can be formed of any suitable material, such as wood, plywood, high-strength plastic, any of a variety of metals such as aluminum or steel, or composites of the foregoing. The structural requirements are that the device 10 should be rigid and should withstand any horizontal force component placed upon it by three ladders and their respective loads.

In FIG. 1, the arms 20 are fashioned to extend outwardly from respectively bases or panels 14, 16 and 18 at an angle of 90° with respect to the vertical, represented in FIG. 1 by a dotted-line vertical axis V. An alternative embodiment is shown in FIG. 2, in which the connecting device, indicated generally at 50, has similar equilateral triangular faces 14, 16 and 18, but in which arms 52 extend both outwardly and downwardly from a central body 54 formed in part by the panels 14, 16 and 18. In this embodiment, the arms 52 make an acute angle with respect to the vertical, such as 60° or 75°. Further, a tray 56 has been added which extends across the bottom of rectangular panels 14, 16 and 18 and can conveniently be used to hold objects. Three crossbars 58 have been added to add strength and rigidity to the arms 52; each of the crossbars 58 joins a respective pair of arms 52 at a point approximately midway between a respective body panel 14, 16 or 18 and a pair of rung receivers 28. Because the arms 52 extend in a downward as well as an outward direction from respective body panels 14, 16 and 18, the structure 50 also permits the addition of three shelves 60, each of which extends between the bottom of the panel 14, 16 or 18 and the crossbar 58. Shelves 60, which in a preferred embodiment are horizontal, provide another area for the storage of objects of use to the ladder climbers. Because of its downwardly directed arms 52, device 50 can be loaded with a considerable weight, the force from which will be partially directed down the ladders themselves after the manner of an arch or vault.

FIG. 3 shows an embodiment of the device, here indicated generally at 70, which is similar in form to the embodiment shown in FIG. 2. Three ladders 72, 74 and 76 have been assembled to respective pairs of rung receiving members 28, which in the illustrated embodiment terminate free ends of six different arms 52. The connecting device 70 has been provided with a grate or platform 78 on which objects may be placed.

The ladders 72, 74 and 76 in the illustrated embodiment happen to be extension ladders. FIG. 3 shows the employment of the connecting device 70 and the ladders 72, 74 and 76 in a situation in which the ground or floor is not level. Ladders 72 and 76 are resting on a stage floor S, while ladder 74 is resting on a floor F which is some distance below the floor S. The device 70 allows adjustment to the situation by receiving different ones of the rungs 80 of the ladders 72, 74 and 76. Thus, a top rung 82 of the ladder 74 is engaged by respective rung receivers 28. A fourth rung 84 of ladder 72 is engaged by respective rung receivers 28 located on that respective pair of arms 52. A third rung 86 of ladder 76 is being engaged by rung receivers 28 of a respective pair of arms 52.

FIG. 3 also illustrates why device 70 provides for a stable structure. The person P, in climbing any one of the ladders 72, 74 and 76, quickly enters a triangular area of which the bottom of the ladders 72, 74 and 76 form the apices. This triangular area or "kern" is the area of stability; the tripod will not be unstable as long as the center of gravity of the load remains within it. As the person P climbs up the ladder, his or her mass becomes more and more central to the three ladders 72, 74 and 76.

Figure 4:
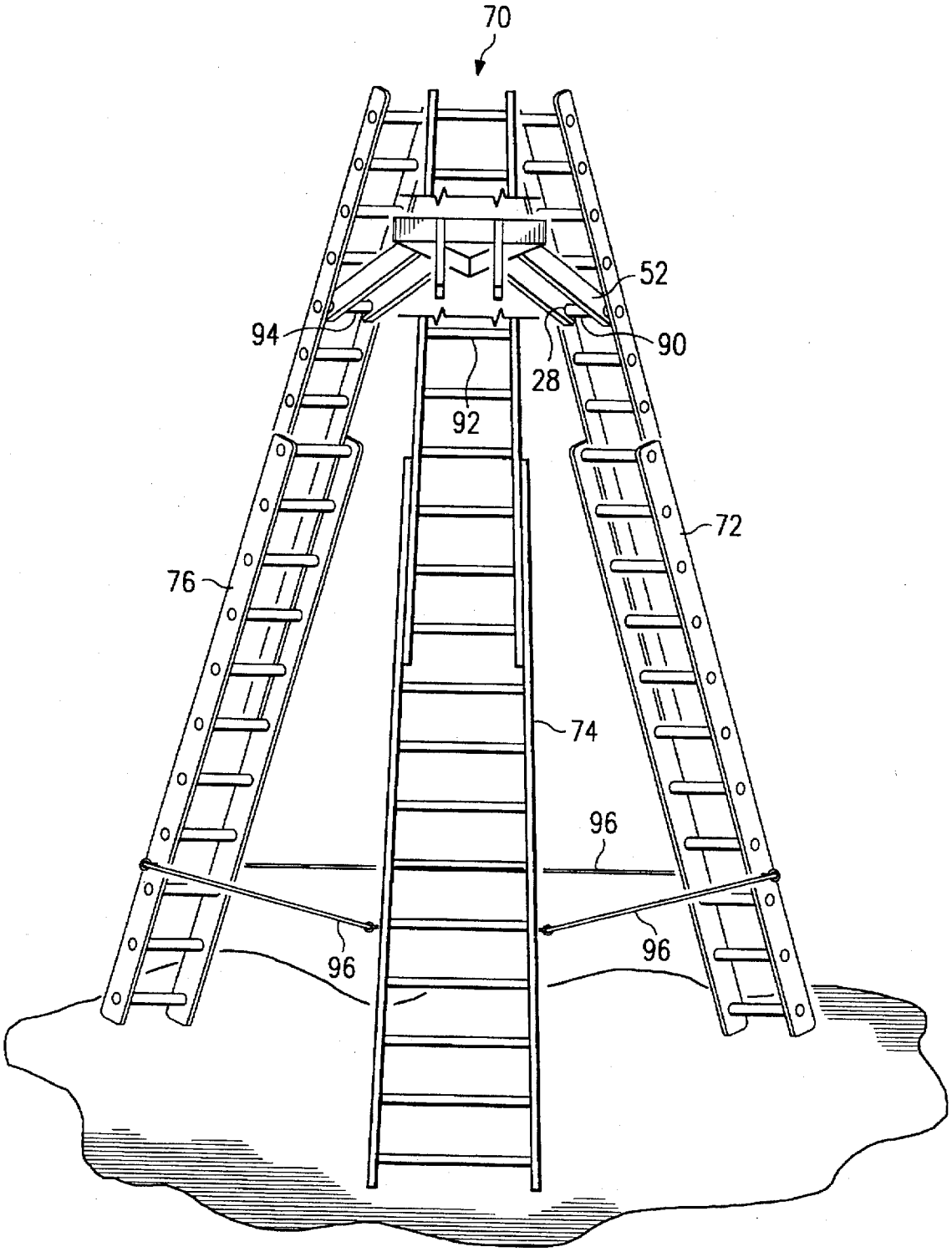
FIG. 4 is an isometric view of a further embodiment of the invention being used to assemble three extension ladders together as a tripod.

FIG. 4 is an isometric view of connecting device 70 being used to assemble ladders 7, 74 and 76 in another situation, with parts of ladder 74 being broken away to show the structure of connecting device 70. Here, the length of arms 52 permits connection of the device 70 to rungs 90, 92 and 94 of respective ladders 72, 74 and 76; these rungs are substantially below the ladder tops. For additional safety, base cables or rods 96 may be added to connect the ladders 72, 74 and 76 at or near their lower ends. If stiff rods 96 are used, they would prohibit both outward and inward displacement of the lower ends of ladders 72, 74 and 76, and the frictional force between the ladder bottoms and the floor would not need to be relied upon to keep ladders 72–76 upright.

Figure 5:
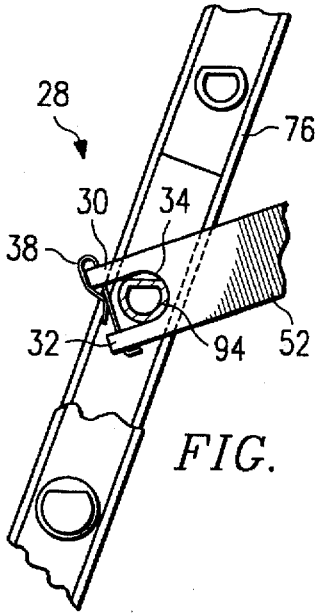
FIG. 5 is elevational detail of FIG. 4, with certain lines of a connected ladder being shown in phantom.

FIG. 5 is a detail of FIG. 4, showing the insertion of rung 94 into a rung receiver 28. The rung 94 is inserted between upper and lower tines 30 and 32 until it is seated against base or seat 34. Clip 38 is then used to secure the rung 94 into place. It is preferred that the arms 52 in each pair thereof (see FIG. 4) be separated by a substantial distance such that the engaged points on rung 94 will be spaced from each other by a substantial distance, militating against rotation of each ladder around its own respective axis.

Figure 6:
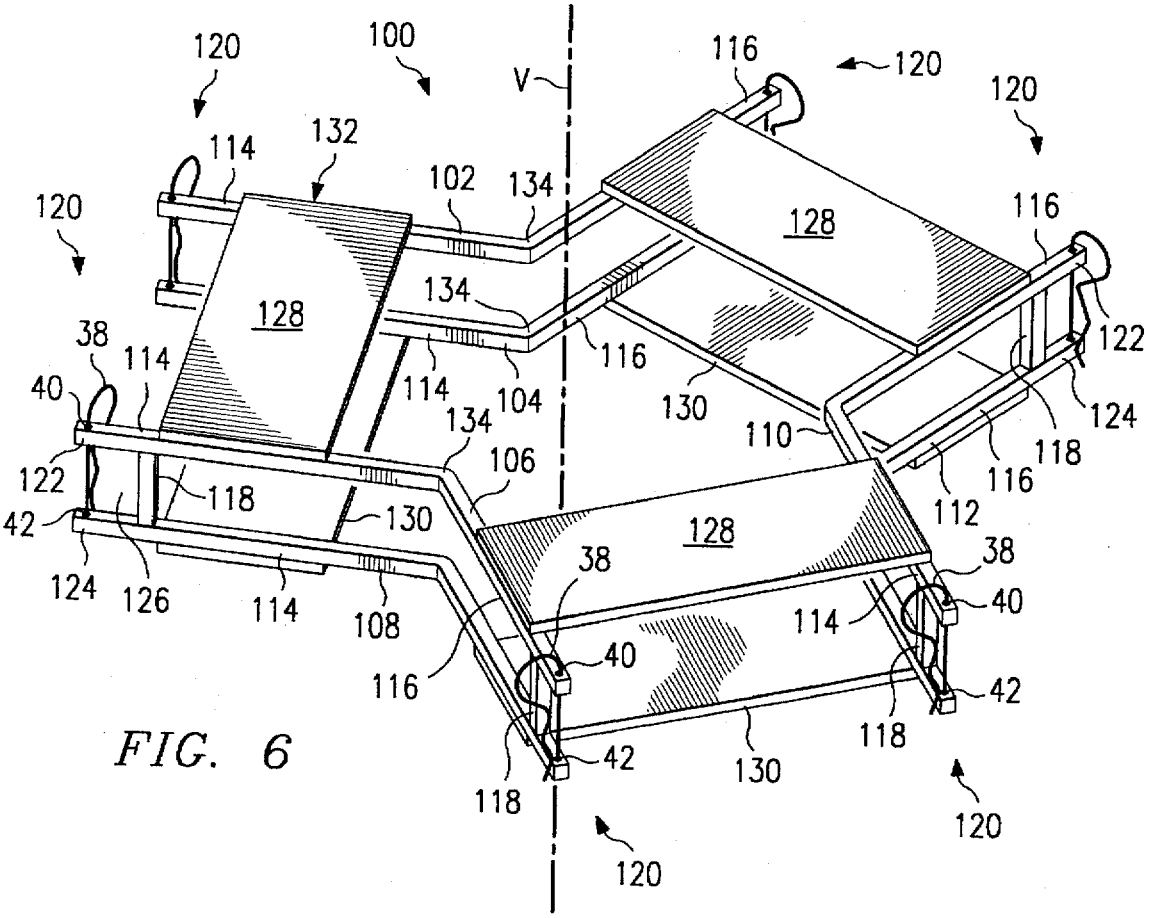
FIG. 6 is an perspective view of a further embodiment of the invention.

FIG. 6 is a perspective view of an alternative embodiment 100 of the invention. This embodiment of the connecting device, indicated generally at 100, includes six elongated angle irons 102, 104, 106, 108, 110 and 112. Each angle iron or bar 102–112 has two branches 114 and 116 which are joined end to end to form an angle, preferably 120°. Other angles may be used where it is desired that the resultant tripod not be equilateral. While the term "angle iron" is used herein, it should be understood that angle irons, bars or rods 102–112 can be formed of any suitable material, such as steel, aluminum alloy, high-strength plastic, wood, or a composite material; steel is preferred for its strength, workability and economy.

Angle irons 102 and 104 are arranged in a pair, as are angle irons 106 and 108 and angle irons 110 and 112. Taking angle irons 106 and 108 as an example, angle iron 106 is disposed vertically above angle iron 108 and is connected thereto by two vertical crossbars or joining members 118. Each crossbar 118 is welded between angle irons 106 and 108 at a point near, but not on, respective mated ends thereof. Thus, each crossbar 118 forms the seat or base of a rung receiver indicated generally at 120. The rung receiver 120 has an upper tine 122 which is an extension of a branch 114 of the angle iron 106, and a lower tine 124 which is an extension of a branch 114 of the lower angle iron 108. The upper and lower tines 122 and 124, in conjunction with the crossbar 118, form a space 126 which is adapted to receive a rung of a ladder. As per the embodiment shown in FIG. 1, a clip 38 is provided to secure the ladder rung in place inside the space 126. The clip 38 is inserted through an upper bore 40 in the upper tine 122 and through a lower bore 42 in the lower tine 124 that is aligned with upper bore 40.

The pairs of arms 102, 104; 106, 108; and 110, 112 are thus assembled in vertical pairs. These pairs of angle irons are joined together to form the connecting device 100 by six horizontal tie members or steel panels 128, 130. The panels 128 and 130, for which other connecting cross members could be substituted, have a width in between the angle irons which they join which is preselected to be somewhat less than the width of the ladder rung to which the rung receivers 120 are to be attached. In the illustrated embodiment, the steel panels 128 and 130 are rectangular and elongated in shape. Angle iron 102 is assembled via an upper panel 128 to the angle iron 106. Angle iron 106 is in turn assembled via panel 128 to the angle iron 110, which is assembled via a final upper panel 128 back to the angle iron 102. Similarly, a lower angle iron 104 is assembled via a lower panel 130 to lower angle iron 108; this is assembled in turn via a panel 130 to the angle iron 112. Angle iron 112 is in turn assembled back to the angle iron 116 though a lower panel 130. The joining technique used in the illustrated embodiment is welding; alternatively, rivets or bolts could also be used or indeed any other fastening technique known in the art.

As is the case in FIG. 1, the branches 116 and 114 of the respective angle irons 102–112 (FIG. 6) have a length which is chosen such that the distance between a seat or base 132 of a rung receiver 120 and an associated corner 134 of the angle irons (see angle irons 106 and 108 in particular) is greater than that portion of the side rail of the ladder to which rung receivers 120 are adapted to be attached which extends above the last rung. Also as before, the length of branches 114 and 116 make it possible to assemble three ladders together at a point considerably below their tops. Panels 128 also provide convenient places for the placement of objects during work on the ladder.

In the illustrated embodiment, the rung receivers 120 are displaced outwardly from a vertical axis V (indicated by a vertical dotted line in FIG. 6) in pairs. A first pair of the rung receivers 120 extends radially outwardly in a first direction which is 120° removed from the directions taken by the other pairs of rung receivers 120. Further, the embodiment in FIG. 6 extends the branches 114 and 116 of the angle irons 102–112 at an angle which is 90° to vertical axis V. In alternative embodiments, the angle irons 102–112 may be so constructed that the branches 114 and 116 extend downwardly as well as outwardly, similar to the arms 52 shown in FIG. 2.

Figure 7:
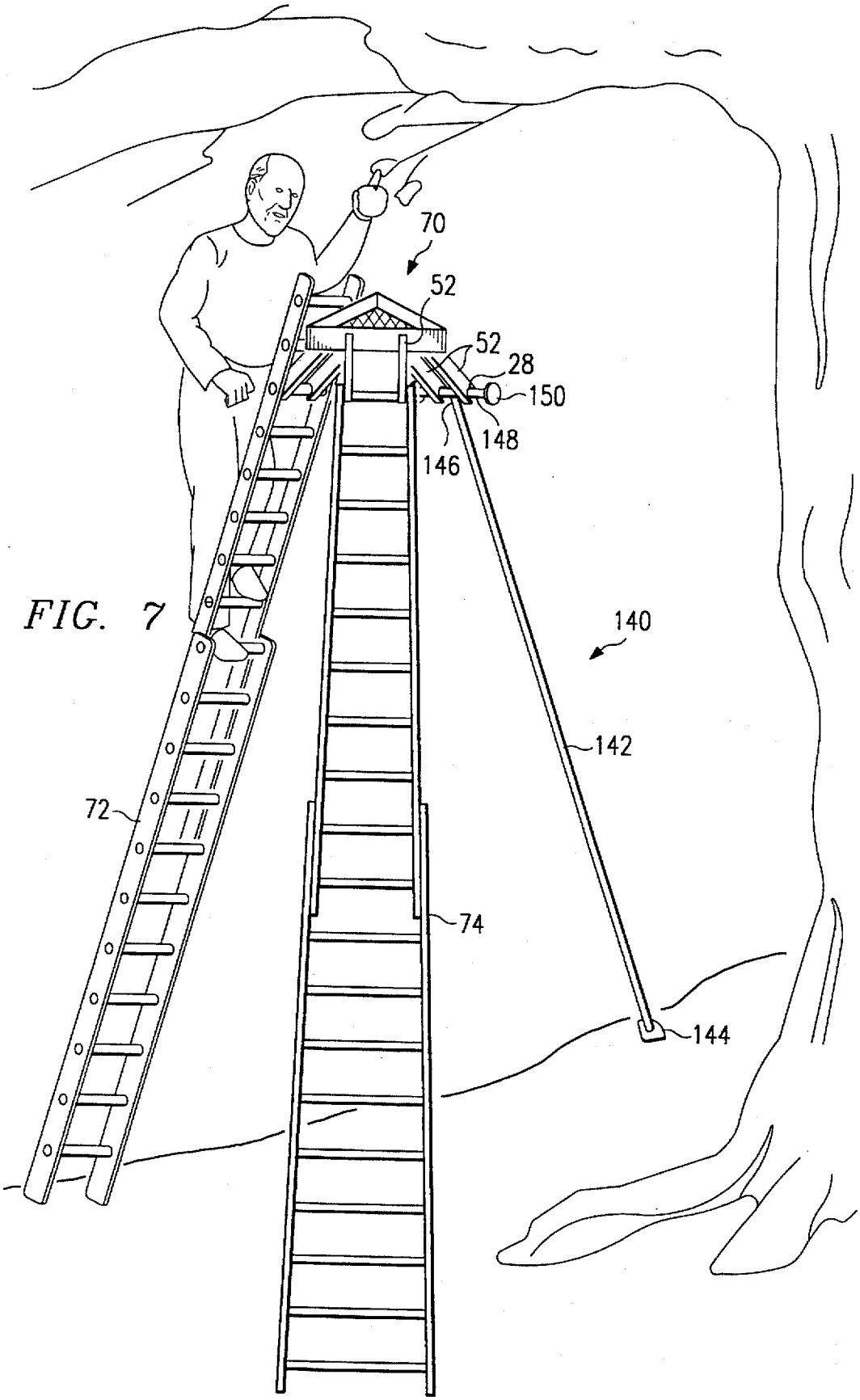
FIG. 7 is an isometric illustration of one embodiment of the invention being employed with two ladders, a support member being used as a substitute ladder.

FIG. 7 illustrates another aspect of the invention in which only two ladders 72 and 74 are used in order to assemble a tripod. A support member indicated generally at 140 takes the place of the third ladder. The support member 140 includes an elongate pole or rod 142 which has a lower end 144 and a upper end 146. Attached to the upper or top end 146 of the rod 142 is a crosspiece 148; in the illustrated embodiment, the crosspiece 148 is attached to the end 146 at its approximate middle. The width and diameter of the crosspiece 148 are preselected so as to correctly engage a pair rung receivers 28 on the ends of respective arms 52; that is, the width of crosspiece 148 is greater than the width between the arms 52 in any pair thereof. Each end of the crosspiece 148 has a thickened or widened member or cap 150 which has a dimension perpendicular to the width of crosspiece 148 that is larger than the space 36 of the rung receiver 28 (see FIG. 1). In this manner, the cap 150 prohibits the arms 52 from sliding off the crosspiece 148. Suitable rung retaining means such as clips (see FIG. 1 for example) are used to retain the crosspiece 148 within the rung receivers 28. In a preferred embodiment, the pole 142 is adjustable as by telescoping sections (not shown) so that a tripod may be assembled at any of various heights.

FIG. 7 also illustrates another use of the invention: fruit picking in orchards. The present invention permits fruit picking or other work with trees or other tall structures on hilly or uneven ground outdoors, in ways to which a scaffold or a stepladder simply could not be adapted.

Figure 8:
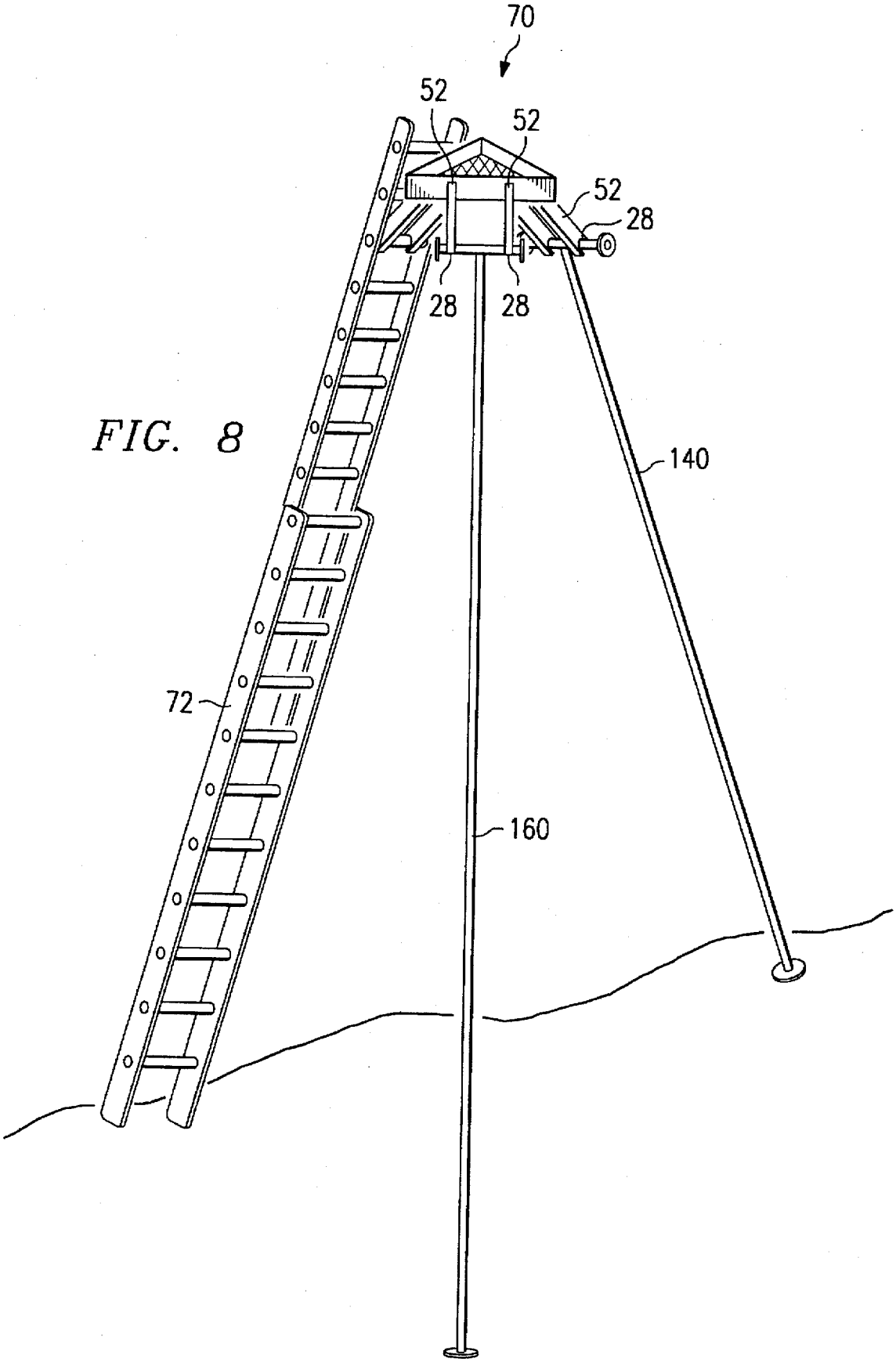
FIG. 8 is an isometric illustration of the invention in which two such support members are used, to form respective legs of a tripod.
Figure 9:
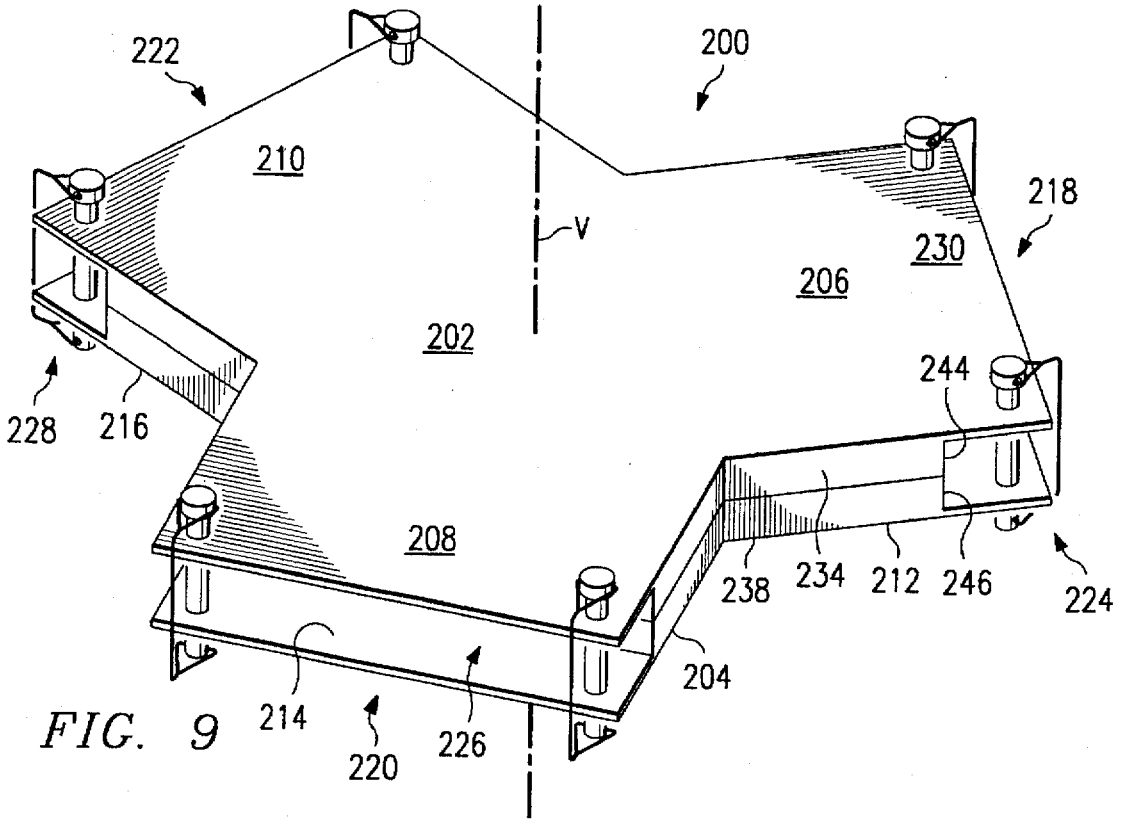
FIG. 9 is a perspective view of a further embodiment of the invention, in which the body thereof is formed by two steel plates.
Figure 10:
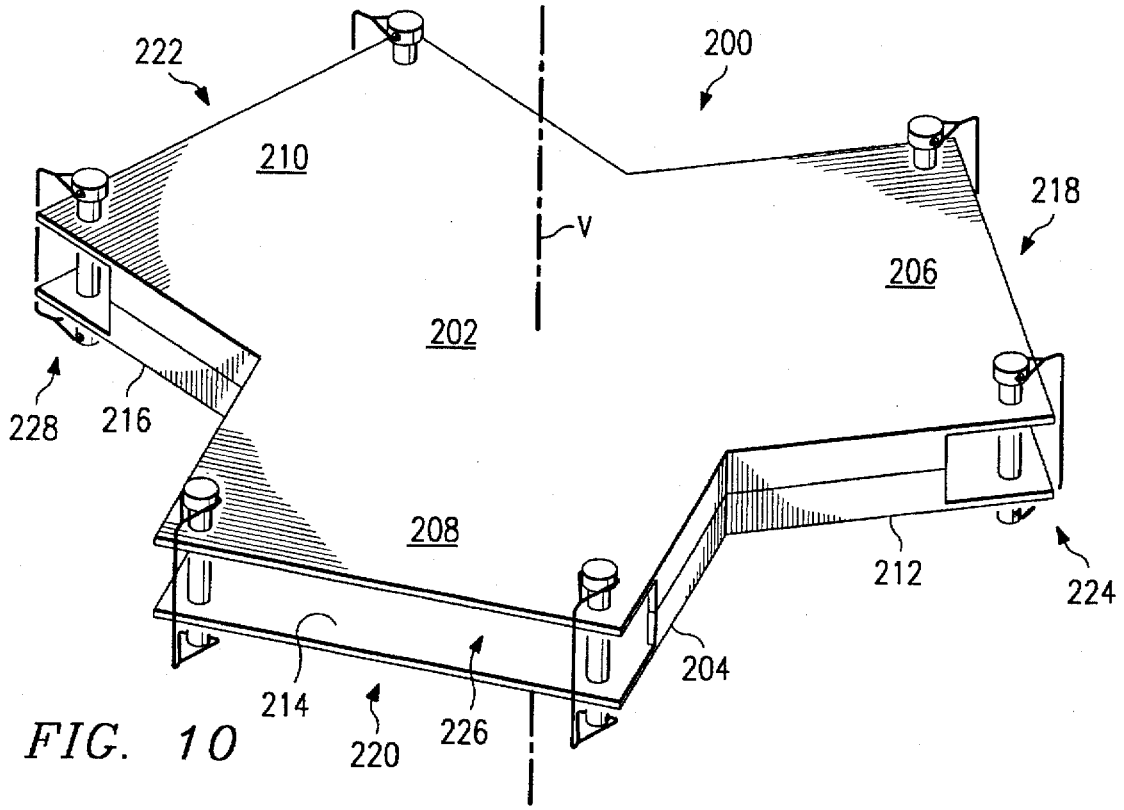
FIG. 10 is a perspective view from a point of view that is more above the apparatus, the embodiment illustrated in FIG. 10 being the same as that pictured in FIG. 9.

FIG. 8 is a variation on FIG. 7, in which two support members 140 and 160 take the place of respective ladders in forming legs of the tripod. Only one ladder 72 is needed in this construction. Support member 160 is constructed in a manner similar to that of support member 140, and like support member 140 engages a respective pair of rung receivers 28 at the end of arms 52.

FIGS. 9–12 illustrate another embodiment of the invention, in which a joining unit according to the invention, indicated generally at 200, is fashioned by joining together a top plate 202 and a bottom plate 204. Each of the plates 202 and 204 have a number of extensions equal in number to the number of ladders to be joined together to make a multi-legged platform. In the embodiment illustrated in FIGS. 9–12, there are three such extensions 206, 208 and 210 of the top plate 202 and three matching extensions 212, 214 and 216 of the bottom plate 204.

The extensions 206–216 are preferably integral with the top plate 202 or the bottom plate 204. Plates 202 and 204 may be formed, for example, from galvanized steel or stainless steel, or another metal having sufficient rigidity for the purpose such as aluminum alloy.

Each of the extensions 206–216 extends away from an axis V of the device 200 in a direction which is angularly separated from the directions taken by the other extensions. Preferably, top plate extensions 206, 208 and 210 extend in directions 120° away from each other, and at an angle which is orthogonal to the axis V.

The ends of extensions 206 and 212 form a side 218, while the ends of extensions 208 and 214 form a side 220 and the ends of the extensions 210 and 212 form a side 222. Sides 218, 220 and 222 are radially spaced away from the axis V and are formed at angles to each other. Each of the sides 218, 220 and 222 has respectively formed thereon a rung receiver, respectively indicated at 224, 226 and 228, which is sized to receive a selected rung of a ladder to be joined.

Figure 11:
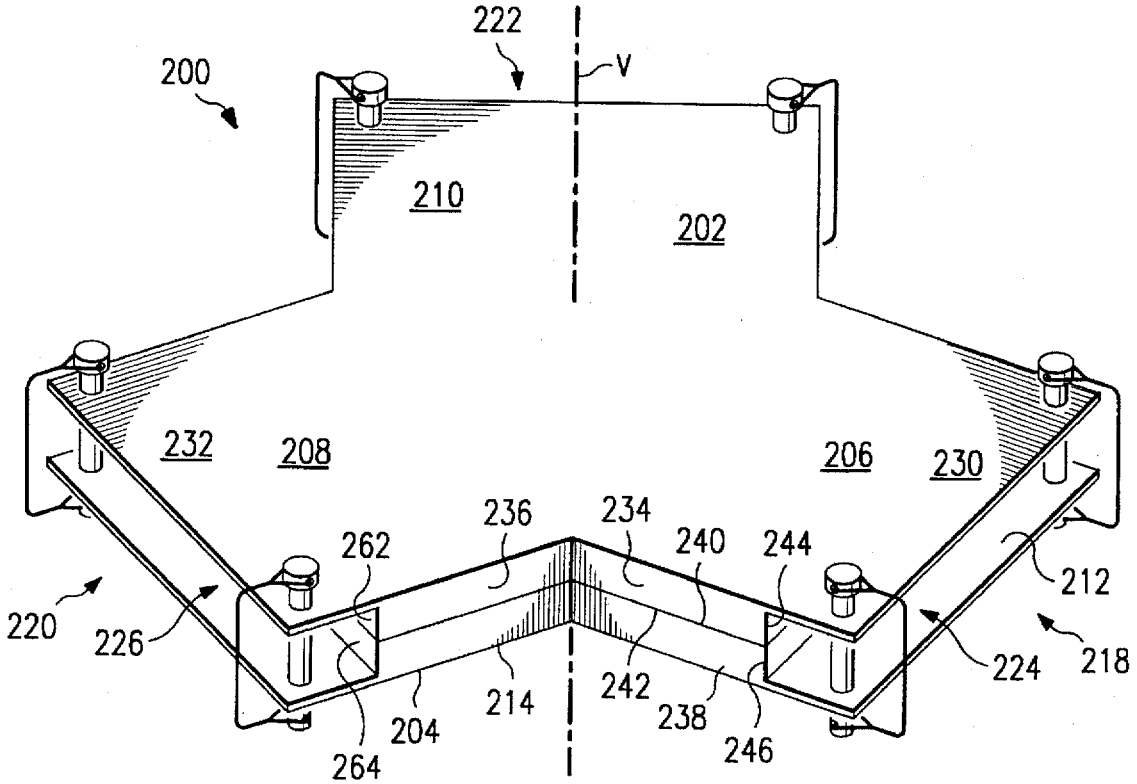
FIG. 11 is a side view of the apparatus shown in FIGS. 9 and 10.

As can be best seen in FIG. 11, each of the extensions 206–210 has an end flange (end flanges 230 and 232 are shown) which preferably is an integral extension of the top plate 202 and is coplanar with the surface thereof. Each of the extensions 206–210 also has a pair of side flanges. A side flange 234 of extension 206 and a side flange 236 of extension 208 are shown. An upstanding side flange 238 of extension 212 of bottom plate 204 has an upper margin 242 which mates with, and is joined to as by welding, the lower margin 240 of the side flange 234. Both side flanges 234 and 238 have a radially outward margin 244, 246. Similar side flanges (not shown) exist on the other side of extensions 206 and 212.

The outer flange 230 of extension 206 extends by a predetermined distance outwardly from the outer margins 244 and 246 of the side flanges 234 and 238, thereby forming respective parts of the rung receiver 224. The rung receiver 224 has a rung receiving opening into which a rung of a ladder (not shown) is received at an angle to the axis V, and preferably this angle is 90°.

Figure 12:
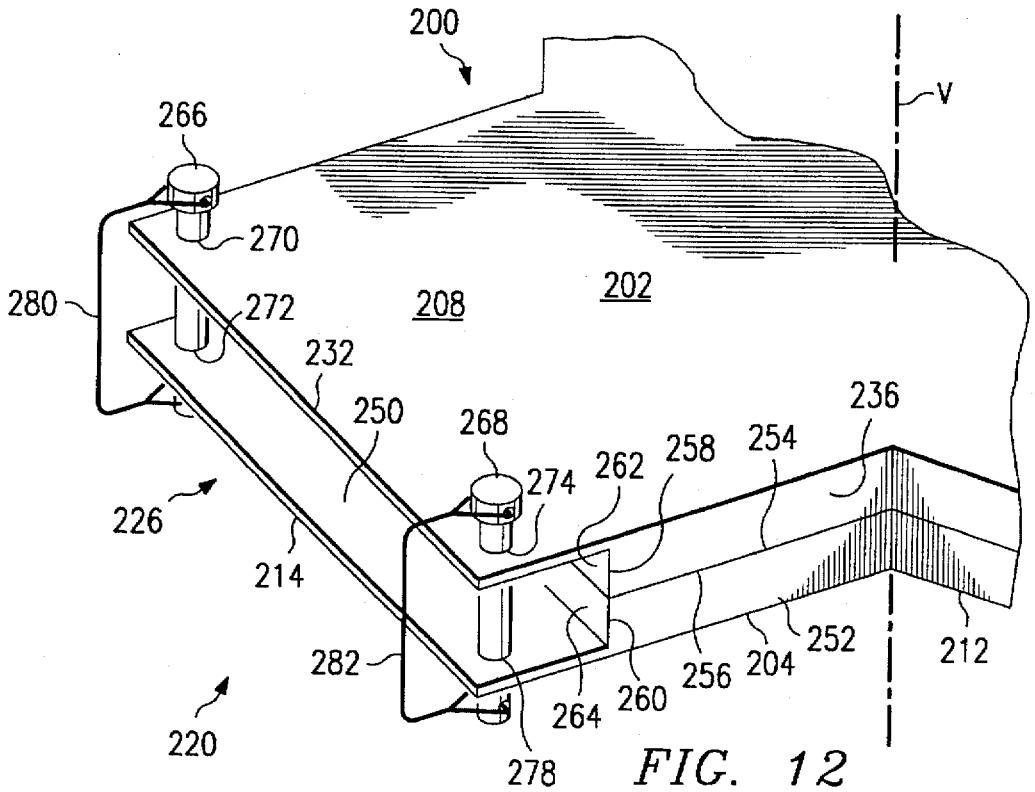
FIG. 12 is an enlarged detail of FIG. 11.

Similar to the structure of rung receiver 224, as shown in FIG. 12 rung receiver 226 is formed of an outward margin 232 of the extension 208 and a matching outwardly extending margin 250 of extension 214. A side flange 236 is bent or otherwise formed to extend downward from the top surface of extension 208 so as to form an angle therewith. A similar side flange 252 is bent or otherwise formed to extend upwardly from the extension 214 of the bottom plate 204. A bottom margin 254 of the sidewall 236 mates with a top margin 256 of the sidewall 252, and these are joined together as by welding. Sidewalls 236 and 252 have radial outward margins 258 and 260, respectively, that in the illustrated embodiment are positioned to be collinear with each other. The outwardly extending flanges 232 and 250 of the extensions 208 and 214, respectively, extend radially outwardly beyond the outer sidewall margins 258, 260 and beyond side margins of like sidewalls in the other side of the extensions (not shown) so as to create three sides of the rung receiver 226.

In the illustrated embodiment, for each extension thereof, each plate 202 and 204 has joined thereto a transverse end piece that joins together the outer margins of the two sidewalls of the extension to which the end piece is welded. Each end piece (end pieces 262 and 264 are shown) has a height which is equivalent to the height of the sidewalls to which it is attached. In the illustrated embodiment, the end pieces 262 and 264 are joined together as by welding to create a solid front for the side 220. This creates a continuous abutting surface against which a rung of the ladder (not shown) will abut once it is received by the rung receiver 226. The rung receivers 224 and 228 (see FIG. 11) are constructed similarly. While in the illustrated embodiment end plates 262 and 264 have been incorporated to enhance the strength of the unit 200, they are not absolutely necessary and may be partially or completely omitted. In an alternative embodiment (not shown) the abutments or stops of each of the rung receivers instead can be formed by the outer margins, such as sidewall margins 258 and 260, alone. This would still permit the engagement of a ladder rung at two points horizontally spaced from each other by the entire width of the extension 208, and in any event by a substantial distance apart for stability.

Using rung receiver 226 as an example, each of the rung receivers has an upper flange or tine 232 and a lower flange or tine 250. Plates 202 and 204 are joined together such that tines or flanges 232 and 250 form an opposed pair which are spaced sufficiently apart that they will receive a rung of a ladder. Once a rung of a ladder has been inserted into the rung receiver 226, pins or bolts 266 and 268 may be inserted through respective pairs of holes 270, 272, 274, 278 to secure the rung in place. A "keeper", such as keepers 280, 282, may be used to secure the bolts 266, 268 in place. The other rung receivers are likewise furnished with similar bolts or pins.

While the embodiment shown in FIGS. 9–12 has been fabricated by a pair of steel or other metal plates having sidewalls which are bent upward or downward to meet mating sidewalls, the unit shown in FIGS. 9–12 may be fabricated in other ways. For example, the entirety of the sidewalls and/or end plates may be fabricated to depend from one of the plates 202 and 204 rather than have opposed pairs of sidewalls meet with a welding seam in the middle. The integral construction of the embodiment shown in FIGS. 9–12 lends itself to being constructed out of plastic; a plastic embodiment of the invention would require thicker outwardly extending flanges, appropriate reinforcing members and/or and appropriate curving or radiusing between transitions.

Similar to the other embodiments shown, the extensions 206–216 have a width which is less than the topmost rung of a conventional ladder, so that the outer flanges 230, 232, 248, 250, etc. may be received between the side rails of the ladder to which they will be assembled (not shown). Further, each of the extensions 206–216 has a sufficient length in a direction orthogonal to the axis V that that portion of the side rails of the ladder (not shown) extending beyond its topmost ring will not engage any of the other extensions of unit 200, permitting three ladders and the unit 200 to be assembled in a flat or a planar condition.

While the embodiments described in this detailed description are each adapted to join three ladders together, other embodiments may join four or more ladders. To join further ladders to the structure, the number of rung receivers and extensions from the axis V are increased, and their angular separation from each other is correspondingly reduced.

In summary, several embodiments of a connecting device have been shown and described which permit the assembly of one, two, three or more ladders into a stable tripod structure. However, while preferred embodiments of the invention have been described in the above detailed description, the invention is not limited thereto but only by the scope and spirit of the appended claims.

What is claimed is:

1. Apparatus for assembling at least three ladders into a multiple-legged platform, comprising:

a body having an axis and at least first, second and third sides spaced from said axis, said first, second and third sides having different angular orientations with respect to said axis, each of said sides forming a stop against which a rung of a ladder may be leaned, each said stop having a width perpendicular to said axis, at least two points of each stop spaced by said width adaptable to abut respective spaced-apart points on said rung of said ladder;

first, second and third rung receivers formed adjacent respective ones of said stops, each said rung receiver having a top projection extending radially outwardly from a respective stop and a bottom projection spaced in an axial direction from said top projection and extending radially outwardly from said respective stop, said projections respectively adapted to extend over and under a rung of a ladder when such a rung is abutted by the respective one of the stops; and said body comprising a top plate having a top surface and first, second and third extensions angularly spaced from each other about said axis, a plurality of sidewalls of each said extension extending downwardly so as to form an angle with said top surface, each sidewall having a radially outward margin and a bottom margin spaced from said top surface;

an end flange of each said extension of said top plate extending radially outwardly from the location of said outer margins of said sidewalls of the last said extension;

said body further comprising a bottom plate having a bottom surface and first, second and third extensions corresponding to said first, second and third extensions of said top plate, a plurality of sidewalls of each said extension of said bottom plate extending upwardly at an angle to said bottom surface, each of the last said sidewalls having a radially outward margin and a top margin spaced from said bottom surface;

an end flange of each said extension of said bottom plate extending radially outwardly beyond the location of said outer margins of the sidewalls of the last said extension; and said top plate joined to said bottom plate by joining bottom margins of said sidewalls of said extensions of said top plate to top margins of respective ones of said sidewalls of said bottom plate, said end flanges of said extensions of said top plate and respective end flanges of said extensions of said bottom plate respectively forming said top and bottom projections of said rung receivers, said outer margins of said sidewalls forming said stops.

* * * * *